US007296945B1

(12) United States Patent
Byun

(10) Patent No.: US 7,296,945 B1
(45) Date of Patent: Nov. 20, 2007

(54) COSMETICS DISCHARGE STRUCTURE OF COSMETICS CASE

(76) Inventor: Young-Kwang Byun, 928-1005, Mok-dong Apt, 312, Shinjeong-dong, Yangcheon-ku, Seoul 158-769 (KR)

( * ) Notice: Subject to any disclaimer, the term of this patent is extended or adjusted under 35 U.S.C. 154(b) by 0 days.

(21) Appl. No.: 11/600,713

(22) Filed: Nov. 17, 2006

(30) Foreign Application Priority Data

Sep. 28, 2006 (KR) ..... 10-2006-0094531

(51) Int. Cl.
*A46B 11/04* (2006.01)

(52) U.S. Cl. ..... 401/286; 401/175; 401/282; 401/176; 401/178; 132/313

(58) Field of Classification Search ..... 401/286, 401/188 R, 282, 187, 176, 178, 269, 283, 401/177, 146, 150; 132/313, 317, 318, 320
See application file for complete search history.

(56) References Cited

U.S. PATENT DOCUMENTS 6,142,695 A * 11/2000 Byun ..... 401/187
6,234,181 B1 * 5/2001 Lou ..... 132/313
6,363,948 B2 * 4/2002 Choi ..... 132/313
6,418,939 B1 * 7/2002 Byun ..... 132/313
6,533,482 B1 * 3/2003 Byun ..... 401/180
6,935,802 B1 * 8/2005 Byun ..... 401/278
7,101,107 B1 * 9/2006 Byun ..... 401/286
7,217,054 B2 * 5/2007 Noguchi ..... 401/277
2002/0040720 A1 * 4/2002 Byun ..... 132/112
2003/0000544 A1 * 1/2003 Byun ..... 132/320
2005/0053415 A1 * 3/2005 Byun ..... 401/270
2007/0098485 A1 * 5/2007 Byun ..... 401/286

* cited by examiner

*Primary Examiner*—Khoa D. Huynh
(74) *Attorney, Agent, or Firm*—Birch, Stewart, Kolasch & Birch, LLP

(57) ABSTRACT

A cosmetics discharge structure of cosmetics case including a receiving part 11, an inner space part 24*a* formed to a cone type elastic part 24 through a opening hole 28, a vertical rod 27, an inner hole 22, and an inner space part 24*a* discharges to a brush 43 through a liquid discharger 42 from the inner hole 22. An inner moving body 10 declines and returns by an expansion of a cone type elastic part 24 formed to the middle member 20 and elastic and repellent force of a spring 41, the vertical rod 27 declines and seals the inner hole 22, closed opening hole 28 opens and a cosmetics including the receiving part 11 will not discharge to the brush 43. The inner hole 22 and the opening hole 28 are open by pressing and releasing inner moving body 10 and the cone type elastic part 24 and the spring 41 that formed in the middle member 20 can be control freely discharge and interception of cosmetics by compressing and the middle member 20 that composed to a liquid transfer passage 21.

2 Claims, 6 Drawing Sheets

COSMETICS DISCHARGE STRUCTURE OF COSMETICS CASE

CROSS-REFERENCE TO RELATED APPLICATIONS

This application claims the benefits of Korean Patent Application No. 10-2006-0094531, filed on Sep. 28, 2006, in the Korean Intellectual Property Office, the disclosure of which is incorporated herein by reference.

BACKGROUND OF THE INVENTION

1. Field of the Invention

The present invention relates to a cosmetics discharge structure of cosmetics case, a cosmetics including in the receiving part moves to a inner space part formed to a cone type elastic part through a opening hole by compressing a receiving part and rising an inner moving body, a vertical rod rises and an inner hole opens by rising an inner moving body to a top, moved cosmetics in an inner space part discharges to a brush through a liquid discharger from the inner hole and releases pushing power to an inner moving body, an inner moving body declines and returns by an expansion of a cone type elastic part formed to the middle member and elastic and repellent force of a spring, a vertical rod declines and seals an inner hole, closed opening hole opens and a cosmetics including a receiving part will not discharge to a brush, an inner hole and an opening hole open by pressing and releasing inner moving body and a cone type elastic part and a spring that formed in the middle member can be control freely discharge and interception of cosmetics by compressing and a middle member that composed to a liquid transfer passage, a cone type elastic part, a coupling member, and an opening valve is formed to one form, is easy to manufacture mold and reduces producing cost by decreasing a assembly processing of a cosmetics case of a present invention. Also, assembly and dismantling of an inner moving body and a coupling member are easy and an inner moving body separates and opens to add cosmetics that can be possible to refill when a cosmetics including an inner moving body is exhausted.

2. Discussion of Related Art

A cosmetics case was formed opening part in an upper part of a tube type case and composed to fix a cosmetics brush. A cosmetic that was in a inner part of a tube type case by compressing and releasing a tube type case discharged to a cosmetics brush to make up but the cosmetics case had a problem that is bad to keep because a cosmetics often leaked unnecessary.

Also, in order to solve a problem above-described, a cosmetics case has been used that a cosmetics stored case is hard material, a discharge leading passage inserted into upper part of the inner moving body composed with inner and outer moving bodies, a cosmetics brush includes in upper part of an outer moving body and a cosmetics that stored in inner moving body discharges to a cosmetics brush by pressing inner moving body.

However, if the cosmetics case repeats movements that discharge cosmetics of powder type or liquid type, inner and outer moving body that compressed by compressing and releasing inner and outer moving bodies can not recover. There is a disadvantage that makes dirty and damage to surround by leaking cosmetics in case of keeping careless. Also, a discharge leading passage that discharges cosmetics composed to many components and needs many mold produce processing. There is a disadvantage that producing cost will be increase by many processing of assembling manufacturing.

SUMMARY OF THE INVENTION

In order to solve a problem above-described, through pressing repeatedly bottom part of inner moving body that is composing to a cosmetics case, a cone type elastic part and a spring that formed in the middle member can be control freely discharge and interception of cosmetics by compressing and an middle member that composed to a liquid transfer passage, a cone type elastic part, a coupling member, and an opening valve is formed to one form, is easy to manufacture mold and reduces producing cost by decreasing a assembly processing of a cosmetics case of a present invention. Also, assembly and dismantling of an inner moving body and a coupling member are easy and an inner moving body separates and opens to add cosmetics that can be possible to refill when a cosmetics including an inner moving body is exhausted.

FIG. 1 is a perspective view of opened tap of a first embodiment according to the present invention; FIG. 2 is separated perspective view of a first embodiment according to the present invention; FIG. 3 is a coupling sectional drawing of a first embodiment according to the present invention; FIG. 4 is a sectional drawing of pushing an inner moving body of a first embodiment according to the present invention;

An inner moving body is including a pressing ring 13 with forming a receiving part 11 that is including a cosmetics in case of cosmetics discharge structure of a cosmetics case that composed to inserted and coupled outer moving body that coupled a cap 50 to a outside of an inner moving body; an middle member 20 thread coupled to upper part of the inner moving body 10, liquid transfer passage 21 that has inner hole 22 formed in upper part, an opening valve is formed in an bottom part of the inner hole 22, a coupling member 25 that is formed by cone type elastic part 24 is formed in circumference, a vertical rod 27 that is inserted into inner part of the liquid transfer passage 21 is formed, an opening hole 28 that is inserted and settled the opening valve is formed, and includes a vertical sealing form 26 that inserted and coupled to inside of coupling member 25; an outer moving body that is coupled to outside of the inner moving body but is including a cap inserting part 32 which is inserted and coupled from upper part of the middle member 20; an upper moving body 40 that is inserted and coupled to upper part of the outer moving body 30 and middle member 20 but settled a spring 41 to a circumference of the middle member 20, includes a brush 43 by forming a liquid discharger 42 to upper part, inserted into a liquid transfer passage 21 formed in the middle member 20 to bottom part, and formed to outer inserting part 45 that is inserted into inside of a cap inserting part 32 formed in upper part of the outer moving body 30 and inner inserting part 44; a cap inserting part 32 of an outer moving body 30 that is inserted and coupled to the upper moving body is coupled with a cap 50.

A cosmetics including in the receiving part 11 moves to a inner space part 24*a* formed to a cone type elastic part 24 through a opening hole 28 by compressing a receiving part and rising an inner moving body 10, a vertical rod 27 rises and an inner hole 22 opens by rising an inner moving body 10 to a top, moved cosmetics in an inner space part 24*a* discharges to a brush 43 through a liquid discharger 42 from the inner hole 22 and releases pushing power to an inner moving body 10, an inner moving body 10 declines and returns by an expansion of a cone type elastic part 24 formed to the middle member 20 and elastic and repellent force of a spring 41, a vertical rod 27 declines and seals an inner hole 22, closed opening hole 28 opens and a cosmetics including a receiving part 11 will not discharge to a brush 43, an inner hole 22 and an opening hole 28 open by pressing and releasing inner moving body 10 and a cone type elastic part 24 and a spring 41 that formed in the middle member 20 can be control freely discharge and interception of cosmetics by compressing.

Also, a middle member 20 that composed to a liquid transfer passage 21, a cone type elastic part 24, a coupling member 25, and an opening valve 23 is formed to one form, is easy to manufacture mold and reduces producing cost by decreasing a assembly processing of a cosmetics case 1 of a present invention.

Also, assembly and dismantling of an inner moving body 10 and a coupling member 25 are easy and an inner moving body separates and opens to add cosmetics that can be possible to refill when a cosmetics including an inner moving body 10 is exhausted.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Hereinafter, preferred embodiments of the present invention will be described with reference to the accompanying drawings.

Figure 1:
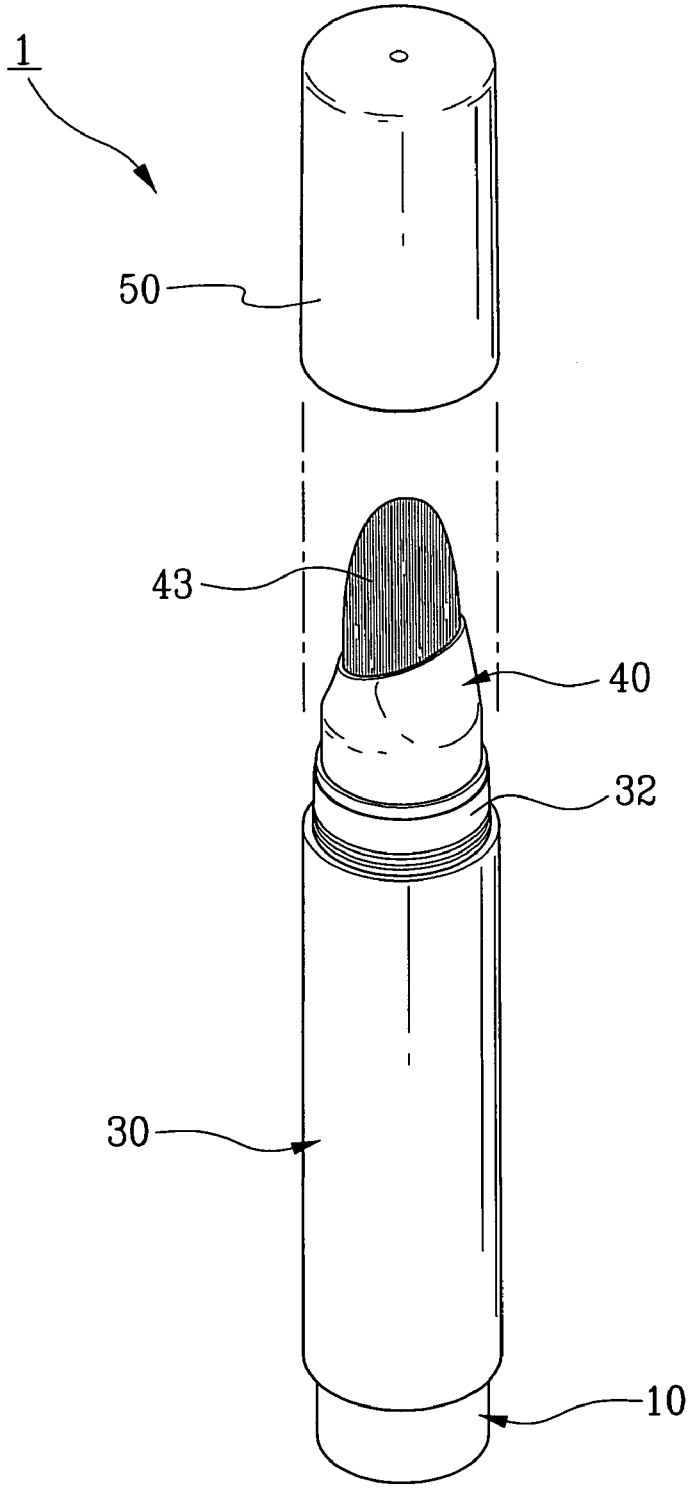
FIG. 1 is a perspective view of opened tap of a first embodiment according to the present invention.
Figure 2:
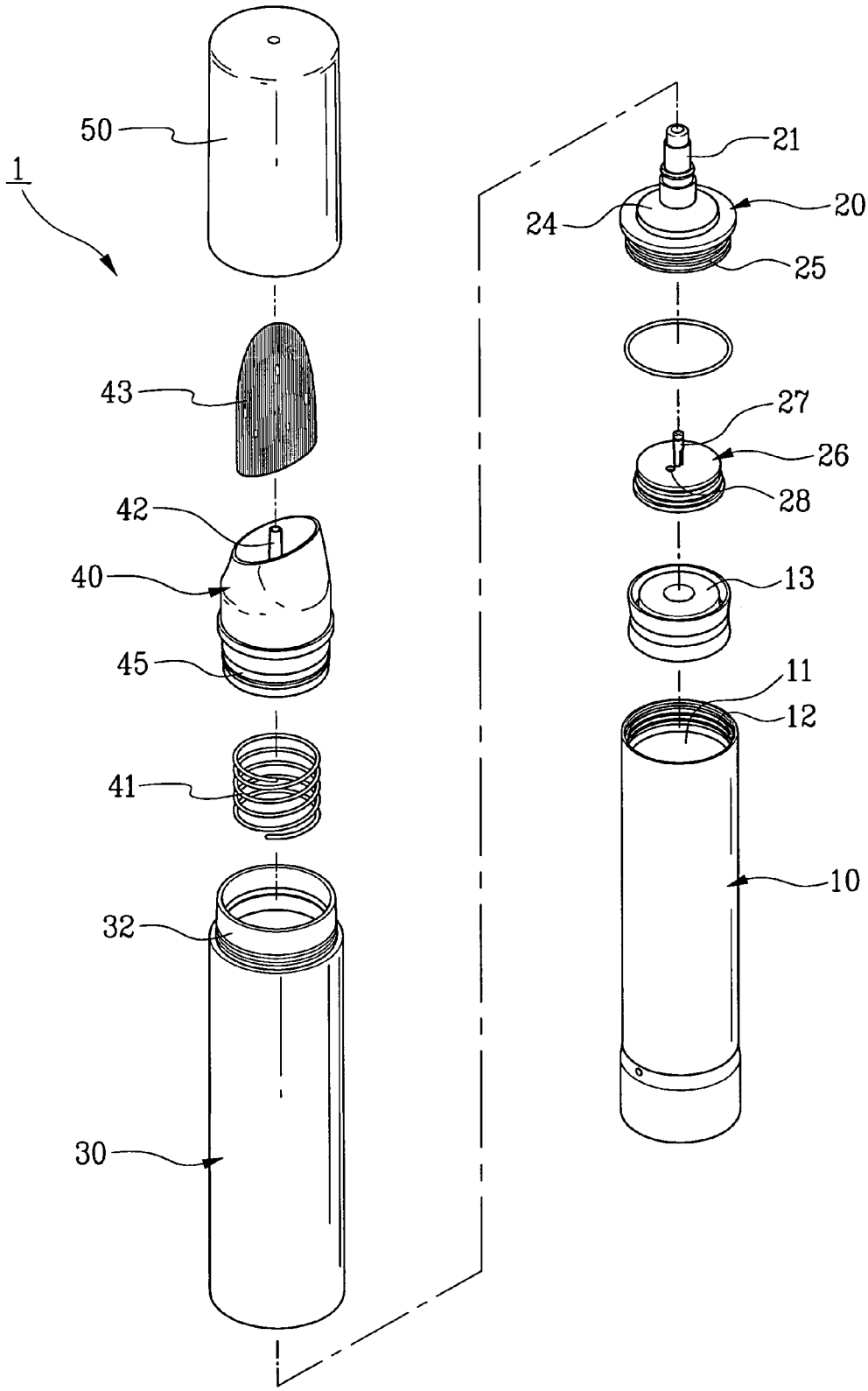
FIG. 2 is separated perspective view of a first embodiment according to the present invention.
Figure 3:
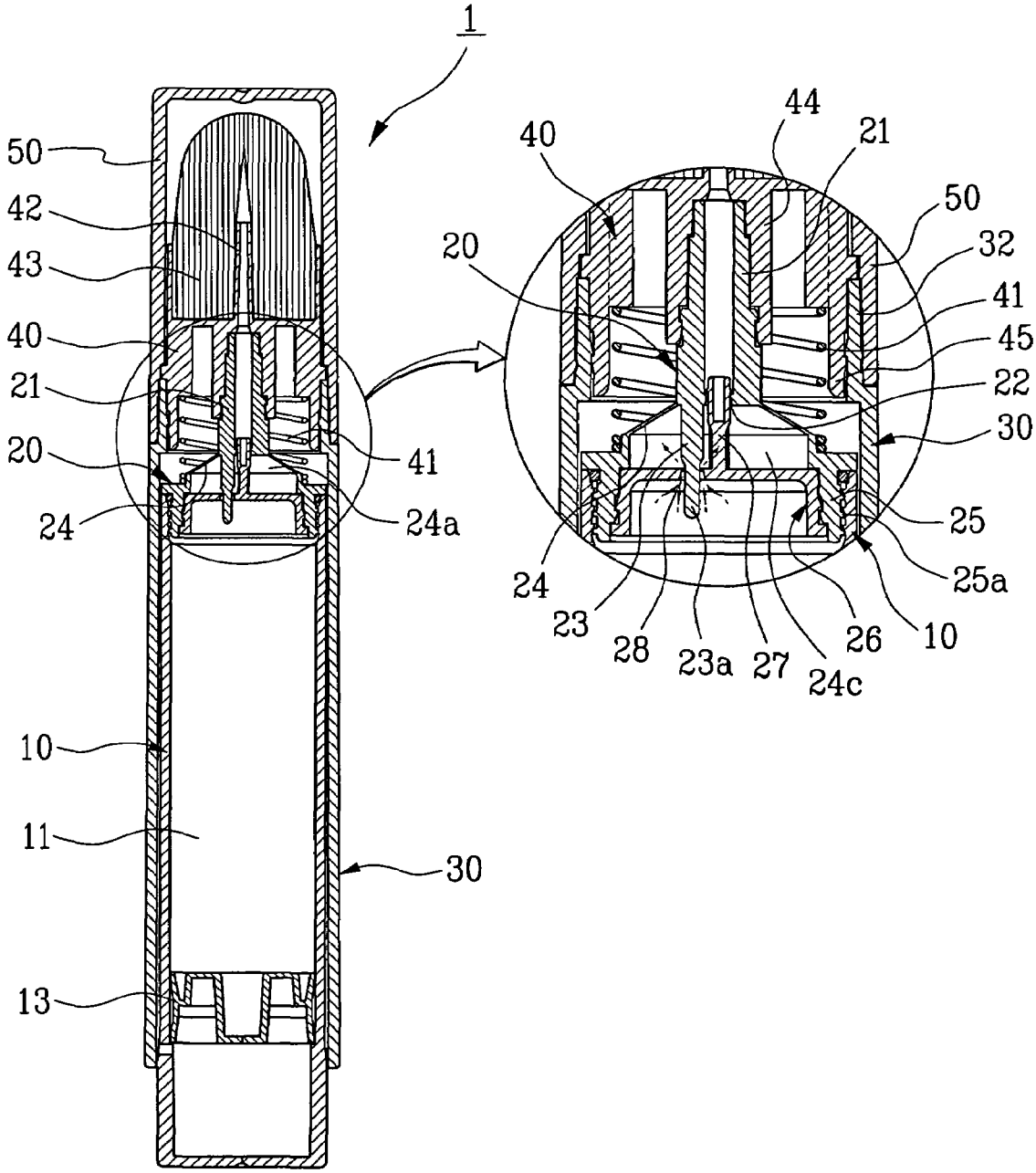
FIG. 3 is a coupling sectional drawing of a first embodiment according to the present invention.
Figure 4:
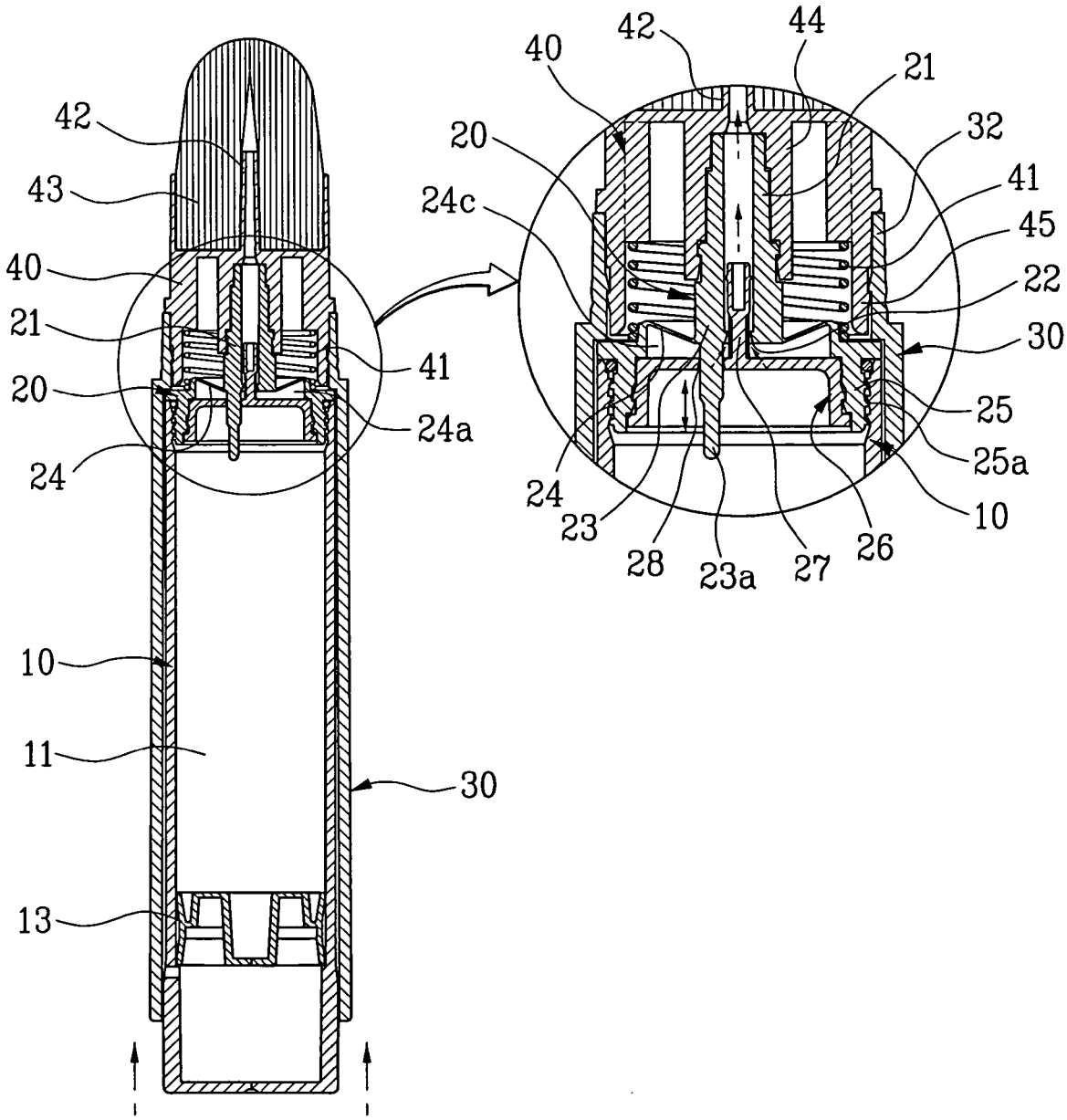
FIG. 4 is a sectional drawing of pushing an inner moving body of a first embodiment according to the present invention.

As illustrated in FIG. 1 and FIG. 3, a receiving part 11 is formed in a inside of inner moving body 10 and is settled a pressing ring 13 and an inner thread 12 is formed in a upper part inner circumference.

An inner thread 12 that is formed in upper part of the inner moving body 10 is thread coupled with a middle member 20 including a coupling member 25 that is inserted and coupled with a liquid transfer passage 21, a cone type elastic part 24 and a vertical sealing form 26.

A liquid transfer passage that moves cosmetics is formed in upper part of a middle member 20 that is thread coupled to upper part of the inner moving body, an inner hole 22 is formed in inside bottom part, and an opening valve that is including an opening projection 23*a* is formed in one side bottom part of the inner hole 22.

Also, a coupling member 25 including an outer thread 25*a* that is formed by cone type elastic part 24 is formed in a bottom circumference of the liquid transfer passage 21, a vertical rod 27 is formed in inside of the coupling member 25, and a vertical including an opening hole 28 is inserted and coupled.

A vertical rod 27 of a vertical sealing form 26 that is inserted and coupled to inside of a coupling member 25 is inserted into an inner hole 22 and coupled and an opening valve 23 is inserted and settled to an opening hole 28.

An outer moving body 30 is inserted and coupled from upper part of coupled the inner moving body 10 and the middle member 20.

An upper part moving body 40 is coupled to upper part of coupled inner moving body 10, middle member 20, and outer moving body 30, a spring 41 is settled in upper part of the middle member 20, a liquid discharger 42 is formed, a brush 43 included, and an inner inserting part 44 inserted into a liquid transfer passage 21 formed in the middle member 20 in bottom part is inserted and coupled with an upper part moving body 40 formed outer inserting part 45 that is inserted into inside of a cap inserting part 32 formed in upper part of the outer moving body 30.

A cap 50 is inserted into upper part of coupled outer moving body 30 and an assembly of a cosmetics case such as the present invention completed.

Figure 5:
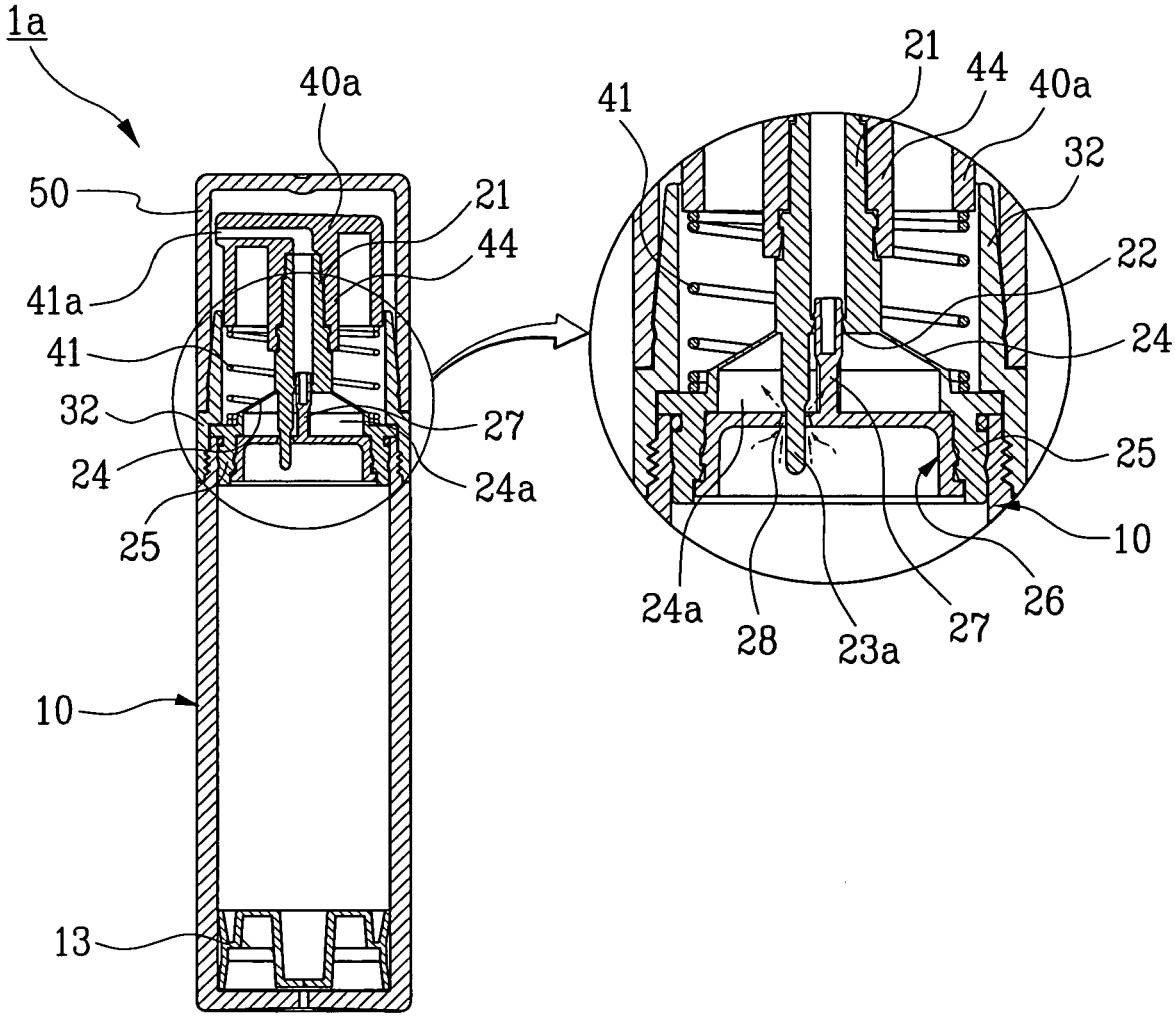
FIG. 5 is a coupling sectional drawing of a first embodiment according to the present invention.
Figure 6:
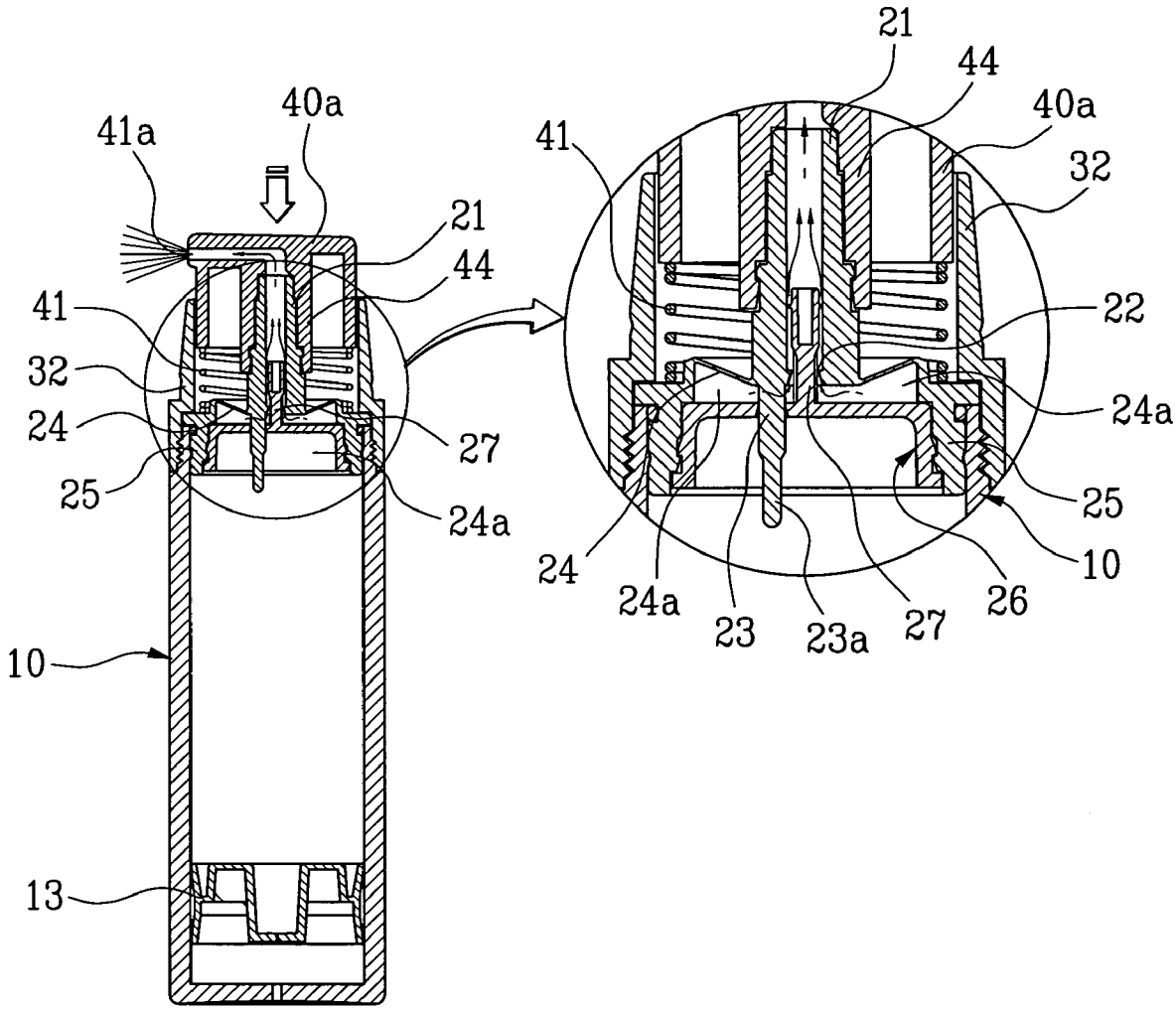
FIG. 6 is a convex expansion sectional drawing of a second embodiment according to the present invention.

FIG. 5 is a coupling sectional drawing of a first embodiment according to the present invention; and FIG. 6 is a convex expansion sectional drawing of a second embodiment according to the present invention. A cosmetics case composed to middle member 20, upper part outer moving body 30 and cap 50 to upper part of inner moving body 10 including a pressing ring 13 to inside. A spray moving body 40*a* including a spray hole 41*a* is inserted and coupled to upper part of the middle member 20.

A cosmetics case 1 sprays cosmetics through a spray hole 41*a* from opening and closing opening valve 23 and inner hole 22 and from compressing a cone type elastic part 24 composing to middle member 20 by compressing and releasing air pressure to inside of inner moving body with ascending and descending spray moving body 40*a* through pressing spray moving body 40*a* repeatedly.

A cosmetic is using first and second embodiments of the present invention can be used with including foundation or liquid cosmetics.

Through pressing repeatedly bottom part of inner moving body that is composing to a cosmetics case, a cone type elastic part and a spring that formed in the middle member can be control freely discharge and interception of cosmetics by compressing and an middle member that composed to a liquid transfer passage, a cone type elastic part, a coupling member, and an opening valve is formed to one form, is easy to manufacture mold and reduces producing cost by decreasing a assembly processing of a cosmetics case of a present invention. Also, assembly and dismantling of an inner moving body and a coupling member are easy and an inner moving body separates and opens to add cosmetics that can be possible to refill when a cosmetics including an inner moving body is exhausted.

What is claimed is:

1. A cosmetics discharge structure of a cosmetics case comprising:

an inner moving body is including a pressing ring (13) with forming receiving part (11) that is including a cosmetics in case of cosmetics discharge structure of a cosmetics case that is composed to inserted and coupled outer moving body that is coupled a cap (50) to a outside of an inner moving body;

an middle member (20) thread coupled to upper part of the inner moving body (10), liquid transfer passage (21) that has inner hole (22) formed in upper part, an opening valve is formed in an bottom part of the inner hole (22), a coupling member (25) that is formed by cone type elastic part (24) is formed in circumference, a vertical rod (27) that is inserted into inner part of the liquid transfer passage (21) is formed, an opening hole (28) that is inserted and settled the opening valve is formed, and includes a vertical sealing form (26) that inserted and coupled to inside of coupling member (25);

an outer moving body that is coupled to outside of the inner moving body but is including a cap inserting part (32) which is inserted and coupled from upper part of the middle member (20);

an upper moving body (40) is inserted and coupled to upper part of the outer moving body (30) and middle member (20) but is settled a spring (41) to a circumference of the middle member (20), includes a brush (43) by forming a liquid discharger (42) to upper part, is inserted into a liquid transfer passage (21) formed in the middle member (20) to bottom part, and is formed to outer inserting part (45) that is inserted into inside of a cap inserting part (32) formed in upper part of the outer moving body (30) and inner inserting part (44);

a cap inserting part (32) of an outer moving body (30) that is inserted and coupled to the upper moving body is coupled with a cap (50).

2. A cosmetics discharge structure of a cosmetics case in accordance with claim 1 wherein the spray moving body (40*a*) including a spray hole (41*a*) is inserted and coupled to upper part of the middle member (20).

* * * * *